United States Patent [19]

Foti

[11] Patent Number: 4,751,453

[45] Date of Patent: Jun. 14, 1988

[54] DUAL PHASE SHIFTER

[75] Inventor: Stephen J. Foti, Tenterden, England

[73] Assignee: ERA Patents Limited, England

[21] Appl. No.: 875,291

[22] Filed: Jun. 17, 1986

[30] Foreign Application Priority Data

Jun. 18, 1985 [GB] United Kingdom ..... 8515403

[51] Int. Cl.[4] ..... G05F 5/00

[52] U.S. Cl. ..... 323/212; 323/218; 333/164; 343/754

[58] Field of Search ..... 323/212, 218, 219; 333/139, 164; 343/754, 905, 909

[56] References Cited

U.S. PATENT DOCUMENTS

| | | | |
|---|---|---|---|
| 3,295,138 | 12/1966 | Nelson . | |
| 3,400,405 | 9/1968 | Patterson, Jr. . | |
| 3,611,400 | 10/1971 | Nagai et al. | 343/844 |
| 4,044,360 | 8/1977 | Wolfson et al. | 343/754 |
| 4,105,959 | 8/1978 | Stachejko . | |
| 4,539,535 | 9/1985 | Miller et al. | 333/164 |

FOREIGN PATENT DOCUMENTS 1559974 1/1980 United Kingdom .

*Primary Examiner*—Patrick R. Salce
*Assistant Examiner*—Anita M. Ault
*Attorney, Agent, or Firm*—Larson and Taylor

[57] ABSTRACT

A variable dual phase shifter for simultaneously varying the phase shifts in two signal paths by equal and opposite amounts comprises two 90° hybrids in the respective signal paths, and a pair of substantially identical transmission lines connecting output ports of one hybrid to output ports of the other. A number of variable-impedance radio-frequency devices, which are preferably p-i-n diodes, are connected to the transmission lines at positions spaced apart along the length of the lines, the positions on one line corresponding to those on the other line. The impedances of the devices are controlled to create a reflective termination at a selected position on one line and a reflective termination at the corresponding position on the other line, so that the phase shift applied to each signal is determined by the distance of the reflective termination from the respective hybrid. The devices may be arranged in pairs, each device of a pair being coupled to a respective one of the transmission lines. Alternatively, signal devices may be provided, each device being coupled to a respective pair of corresponding positions on the lines via two ¼-wavelength lines. Two or more of the phase shifters may be connected to cascade to provide progressively finer phase shift steps.

8 Claims, 3 Drawing Sheets

DUAL PHASE SHIFTER

This invention relates to a variable dual phase shifter for simultaneously varying the phase shifts in two signal paths by equal and opposite amounts.

Simultaneous equal and opposite variable control of the phase shifts in two signal paths is a requirement in many radio frequency networks, such as phased array feed antenna networks and polarisation diverse antenna control networks. In the past, this requirement has usually been satisfied by controlling independent phase shifters in the two signal paths by means of two separate control signals. However, with this solution, exactly equal and opposite phase shift control (i.e. a phase shift of $+\Delta\phi$ in one path and $-\Delta\phi$ in the other) is achieved only if the control signals are exactly correct and if the variable rf devices within the phase shifters are identical.

It is an object of the present invention to provide a variable dual phase shifter having improved control over the phase relationship, while also significantly reducing the number of variable rf devices without degrading performance.

According to the invention there is provided a variable dual phase shifter for simultaneously varying the phase shifts in two signal paths by equal and opposite amounts, characterised by a pair of substantially identical transmission lines; a pair of 90° hybrids each having two normal output ports, the output ports of one hydrid being connected to the output ports of the other hybrid via the pair of transmission lines; a number of variable-impedance radio-frequency devices coupled to the transmission lines at positions spaced apart along the lines, the positions on one line corresponding to those on the other line, as measured from the same hybrid; and means to control the impedances of the radio-frequency devices to create a reflective termination at a selected position on one line and a reflective termination at the corresponding position on the other line. In other words, the impedances of the radio-frequency variable-impedance devices are each controlled so as to provide a reflective shut impedance, different from the characteristic impedance of the associated line, at corresponding positions on the two lines.

A variable dual phase shifter in accordance with the invention is designed to be connected in the two signal paths so that the paths pass one through each 90° hybrid from its normal input port to its normally isolated port, which now becomes the output port. The length of the transmission lines from each 90° hybrid to the plane of the reflecting terminations determines the phase shift (or delay) imparted to the corresponding signal path, and hence controlling the radio-frequency devices to move the reflecting plane closer to one of the 90° hybrids will shorten the path length of the signal path through that hybrid and increase the path length of the other signal path by a corresponding amount, thereby simultaneously varying the phase shifts in the two signal paths by equal and opposite amounts.

The radio-frequency devices may be arranged in pairs, so that devices of each pair are coupled to corresponding positions on the two transmission lines. The devices of a pair are controlled together, so that they exhibit the same impedance as each other, and the same control signal can be used for the pair.

Preferably, each variable impedance radio-frequency device comprises a p-i-n diode which is connected between the transmission line and ground and which is arranged to be controlled between two states, one presenting a low impedance allowing the short circuit to form a reflecting termination for the transmission line, and the other presenting a high impedance and an effective open circuit. If desired, however, each of the radio-frequency devices may be arranged to exhibit a finite resistance which is varied by means of its control signal, whereby the dual phase shifter can also provide variable attenuation to the two signal paths (the same for each).

Embodiments of the invention will now be described, by way of example, with reference to the accompanying drawings, in which.

Figure 1:
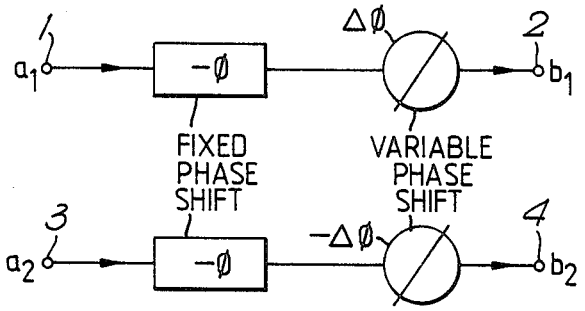
FIG. 1 is a diagram illustrating the desired operation of a variable dual phase shifter.

The function of the dual phase shifter is to provide simultaneous equal and opposite variable control of the phase shifts in two signal paths. In FIG. 1 this function is indicated by a first signal path 1, 2 including an unavoidable fixed phase shift $-\phi$ and a variable phase shift $\Delta\phi$, and a second signal path 3, 4 including the fixed phase shift $-\phi$ and a variable phase shift $-\Delta\phi$. In other words, whenever there is a phase shift increase of $\Delta\phi$ in the first signal path 1, 2 there must be a simultaneous exactly equal phase shift decrease in the second signal path 3, 4 and vice versa.

If the input signals fed to the ports 1 and 3 are $a_1$ and $a_2$, respectively, the output signals $b_1$ and $b_2$ at the ports 2 and 4, respectively, will be given by $$b_1 = ka_1 e^{j(\Delta\phi-\phi)}$$

$$b_2 = ka_2 e^{-j(\Delta\phi+\phi)}$$

where k is a constant $\leqq 1$. It should be noted that $a_1$, $a_2$, $b_1$ and $b_2$ are complex voltage wave amplitudes.

Figure 2:
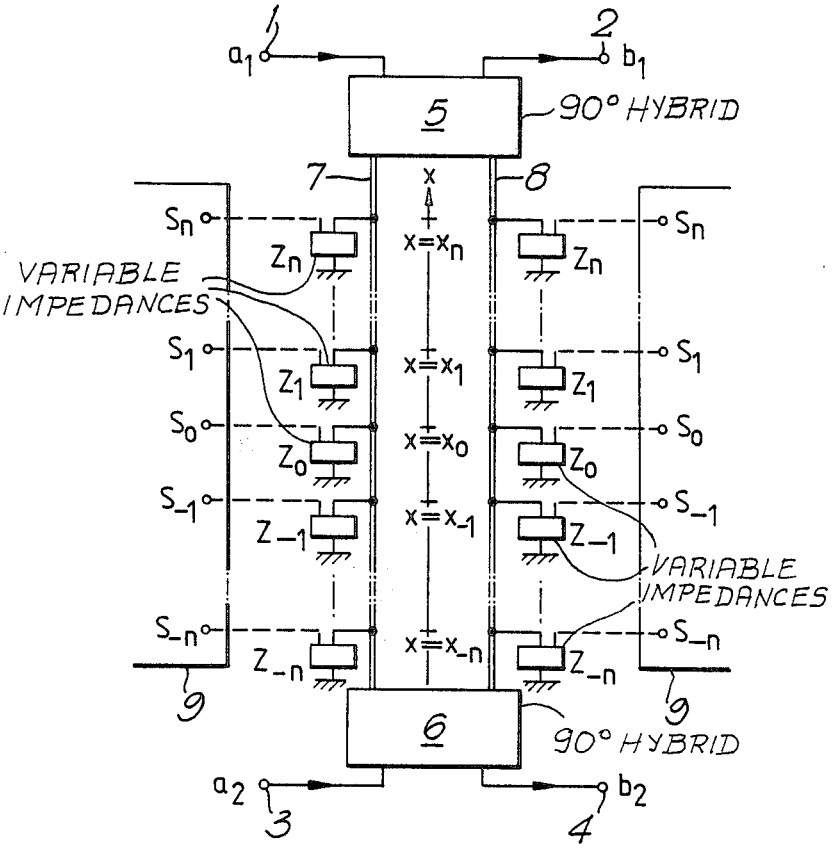
FIG. 2 is a schematic block diagram illustrating the principle of construction of a variable dual phase shifter in accordance with the invention.

The principle of a dual phase shifter in accordance with the invention is illustrated in FIG. 2. The phase shifter comprises a pair of 90° hybrids 5 and 6 connected as shown in the signal paths 1, 2 and 3, 4, respectively, and each having its normal output ports connected to the normal output ports of the other by a pair of identical transmission lines 7 and 8. At corresponding positions along the lengths of the transmission lines 7 and 8, each line has a similar variable impedance radio-frequency device shunt connected to it as indicated by impedances $Z_n, \ldots Z_1, Z_0, Z_{-1}, \ldots Z_{-n}$, the correspondingly positioned devices forming a pair, each pair being controlled by a common control signal $S_n, \ldots S_1, S_0, S_{-1}, \ldots S_{-n}$. The locations of the pairs of variable rf devices disposed along the transmission lines 7, 8 between the two 90° hybrids 5, 6 may be defined as positions along an x axis shown in the figure. The transmission line lengths between the locations of the pairs of rf devices provide the necessary variable phase delays required for the operation of the phase shifter, although at low frequencies it may be more practical to implement these phase delays by inserting a two-port network in lieu of excessive lengths of transmission line. Typical variable rf devices which may be used are p-i-n diodes, i.e. diodes comprising a layer of intrinsic (i-type) semiconductor material between p-type and n-type regions, or electromechanical rf switches. Such diodes are preferably controlled between two states, which are ideally short-circuit and open-circuit states. The devices are controlled in pairs such that, at any instant, both devices of any pair exhibit the same impedance as each other.

This phase shifter network makes use of the fact that when the two normal output prots of a 90° hybrid are terminated in identical impedances, the reflected rf waves are routed to the normally-isolated port, which in this system becomes one of the output ports 2 or 4 of the network. The waves are not reflected back to the input port 1 or 2. Therefore, if all of the impedances $Z_n$, ... $Z_1$, $Z_{-1}$, ... $Z_{-n}$ are controlled to be identical high impedances, and $Z_0$ is controlled to be low impedance, then assuming that $x_0=0$ (i.e. the pair of $Z_0$ variable rf devices are located in the transmission lines 7 and 8 midway between the two 90° hybrids 5 and 6) $\Delta\phi=0$. In other words, the two signal paths have identical phase shifts since the path length from the port 1 along the transmission lines 7 and 8 to the reflection plane $x=0$ and back to the port 2 is the same as the path length from the port 3 along the transmission lines 7 and 8 to the reflection plane $x=0$ and back to the port 4. In contrast, if all of the impedances $Z_n$, ... $Z_2$, $Z_0$, $Z_-$, $Z_{-2}$, ... $Z_{-n}$ are controlled to be identical high impedances and the $Z_{+1}$ impedances are controlled to be identical low impedances, the reflection plane is now removed to the position $x=x_1$. $\Delta\phi$ then becomes equal to $$\frac{(4\pi x_1)}{\lambda}$$

radians, and the signal path between the ports 1 and 2, via the transmission lines 7 and 8 to the plane $x=x_1$, is shortened by $\Delta\phi$, whereas the signal path between the ports 3 and 4, via the transmission lines 7 and 8 to the plane $x=x_1$, is lengthened by $\Delta\phi$.

It will be obvious that by suitable control of all of the rf device impedances $Z_n$ ... $Z_0$ ... $Z_{-n}$ by the control signals $S_n$ ... $S_0$ ... $S_{-n}$, $\Delta\phi$ can be varied over any desired range of discrete values. Furthermore, if the impedances are short-circuit or open-circuit, or are purely reactive, then ideally $k=1$ (for ideal hybrids and transmission lines). However, as mentioned earlier, if the impedances also exhibit a finite resistance which is variable by means of the control signal, then k is a variable and the phase shifter network provides the added rf function of variable attenuation, the level of which is the same in both signal paths.

Figure 3:
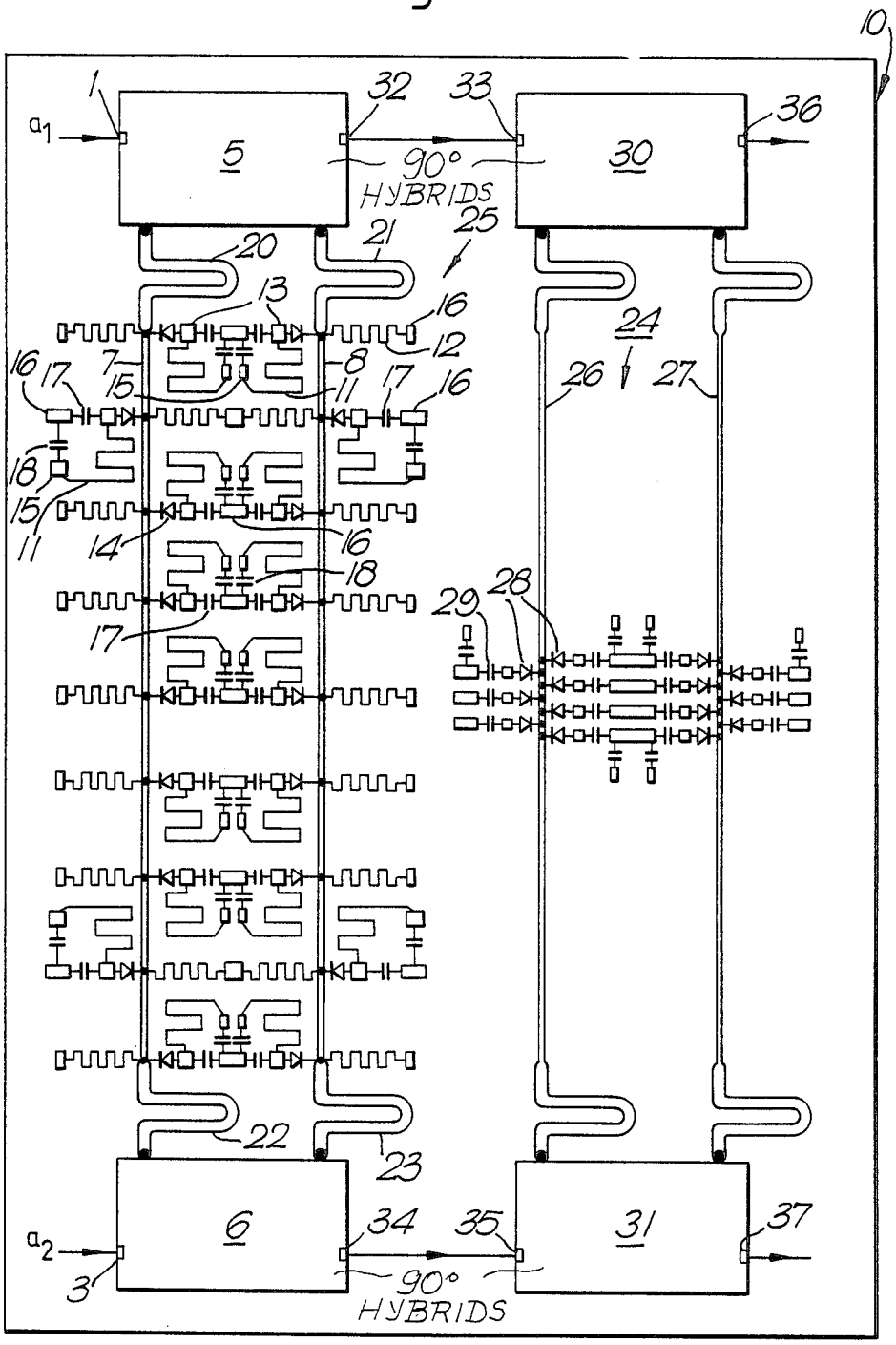
FIG. 3 illustrates a layout of one form of dual phase shifter in accordance with the invention.

FIG. 3 of the drawings shows an example of a suitable layout for a phase shifter in accordance with the invention. The circuit is formed on a circuit board 10, on which are printed the 90° hybrids 5 and 6, the lines 7 and 8, together with control signal feed lines 11, tuning stubs 12, connecting points 13 for connecting the p-i-n diodes 14, connecting points 15 for connecting the control signal source to the lines 11, and connecting points 16 for use as ground connections. The cathode connections of the diodes 14 are soldered to their respective points on the lines 7 and 8, and their anodes are connected via respective tuning capacitors 17 to ground. It will be apparent that the polarity of the diodes could, if desired, be reversed. The capacitors 17 are provided for tuning-out the inductive reactance which is exhibited by the respective diode 14 when it is turned on. Capacitors 18 are provided, between the control signal feed lands 15 and ground, to suppress unwanted rf signals which could otherwise enter the control circuits. The ends of the lines 7 and 8 are connected, via loops 20–23, to the ports of the 90° hybrids 5 and 6, which are shown schematically. The loops constitute ¼-wavelength transformers for impedance matching the transmission lines to the hybrids. The lines 11 act as a relatively high impedance at the rf signal frequencies, but as a low impedance between the control signal feed lands 15 and the anodes of the respective diodes as as the control signals are concerned. Similarly, the ¼-wavelength stubs 12 provide a low-resistance dc path for the diode current, but act as a high impedance to the rf signal. The stubs 12 also provide inductive reactance for tuning out the capacitive reactance exhibited by the diodes when they are turned off.

The section of the phase shifter so far described has nine pairs of diodes 14 connected at equally-spaced points along the lines 7 and 8. This arrangement provides, for example, phase-change steps, at the centre frequency, of 45° over a range of ±180°. If finer steps are required it would be necessary, using a single pair of lines and hybrids, to provide many pairs of diodes. For example, if 7.5° steps are required, this would necessitate the use of forty-nine pairs of diodes. This would be excessive, and the resulting phase shifter would be relatively expensive and difficult to construct.

However, this problem can be overcome by providing a "fine" phase shift section 24 in cascade with the "coarse" section 25 just described. The fine section 24 is provided alongside the coarse section 25 on the board 10. It comprises two lines 26 and 27, similar to the lines 7 and 8, and seven pairs of diodes 28 located at the central region of the lines. The seven diodes for each line are so spaced that they take up a length of line equal to the length between adjacent diodes of the coarse section 25, the fine section they yielding six steps of 7.5° each. Tuning capacitors 29 are provided for the same purpose as the capacitors 17 of the coarse section. Control signal feed lines and tuning stubs are provided, to perform the same functions as the lines 11 and the stubs 12 of the coarse section, but are omitted from the figure for the sake of clarity. The lines 26 and 27 are connected at their ends to the output ports of 90° hybrids 30 and 31, just as in the coarse section. Ports 32 and 33 of the hybrids 5 and 30 are connected together, as are ports 34 and 35 of the hybrids 6 and 31.

In the use of the phase shifter, the signals $a_1$ and $a_2$ are fed into the ports 1 and 3, respectively, of the hybrids 5 and 6. The signals are phase-shifted by an amount determined by the position of the pair of diodes which is made conductive, as previously described. Let us assume that a phase shift $\Delta\phi$ of 100° is required. As the steps of the coarse section are 45° apart, it is possible to select either 90° or 135°. If the 90° position is selected, and the thus phase-shifted signals are passed from the hybrids 5 and 6 to the hybrids 30 and 31, the relevant pair of diodes 28 is selected to give a further phase shift of 7.5°, and the signals having an overall differential phase shift of ±97.5° are fed to output ports 36 and 37 of the hybrids 30 and 31, respectively. It should be noted that for this design example the desired phase can always be reached to within ±3.75°, which typically is quite acceptable.

It will be apparent that if the coarse section provides N° steps, and N/m° steps are required from the overall device, it will be necessary to provide only m/2 pairs of diodes on each side of the $Z_0$ position in the fine section. For example, if the coarse section has 40° steps, but 10° steps are required, m=40/10=4. Hence, only 2 pairs of diodes on each side of the $Z_0$ position will be required in the fine section. If we consider the desired phase shift of 100° mentioned above, this can be obtained as 80° in the coarse section plus the second 10° step on the same side of the $Z_0$ position (i.e. +20°) in the fine section. If the requirement is now changed to 110° phase shift, the next position (120°) of the coarse section can be selected, together with the first 10° step on the other side of the $Z_0$ position (i.e. −10°) in the fine section. If necessary, further sections may be provided in cascade, providing progressively finer phase shift steps.

Figure 4:
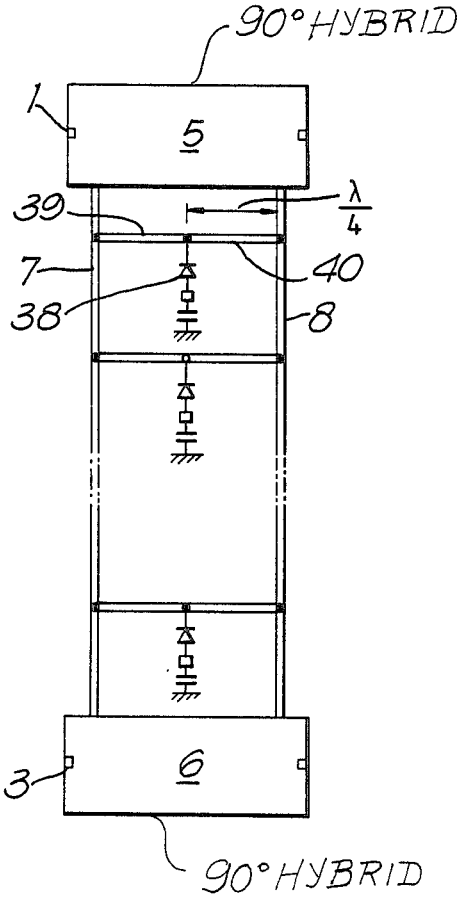
FIG. 4 is a schematic block diagram of an alternative form of dual phase shifter in accordance with the invention.

Instead of using pairs of diodes connected to corresponding positions on the two lines as described above, it would be possible, in some circumstances, to use single diodes 38 coupled to the pairs of lines 7, 8 and 26, 27 via respective ¼-wavelength transmission lines 39, 40 as shown schematically in FIG. 4 of the drawings. Such an arrangement would clearly be simpler and less expensive to construct than the previously-described phase-shifters using pairs of diodes, but it will be apparent that the lines 39 and 40 will act properly as ¼-wavelength lines over only a relatively small frequency range. The bandwidth which can be accommodated with such an arrangement is therefore somewhat limited.

Although it is proposed above to switch on only one pair of diodes (or a single diode in the case of FIG. 4) at a time, it may be found, in some circumstances, that a portion of the signal $a_1$ from the input 1, travelling along the lines 7 and 8, actually gets past the short-circuited diode(s) and proceeds along the lines into the signal path of the signal $a_2$, causing crosstalk. Similarly, the signal $a_2$ can pass into the $a_1$ signal path. The cause of this problem is the above-mentioned inductive characteristic of the turned-on diodes. It may, therefore, be found helpful to switch not only the desired diode on each line, but also the next diode along the line, in order that the second diode, in whichever direction is being considered, may reflect any spurious signal which has passed the first diode. An extra pair of diodes would then be provided in the coarse section, so that it has ten equally-spaced pairs of diodes, the fifth and sixth pairs being switched simultaneously to attain the $Z_0$ position. The other positions would similarly be selected by switching the relevant adjacent diode pairs. The fine section would then have eight pairs of diodes, switched in a similar manner to those in the coarse section.

A variable dual phase shifter in accordance with the invention will provide several improvements and advantages over conventional systems using two independent phase shifters. Such improvements and advantages include:

(1) excellent asymmetric phase tracking between the two signal paths, even with non-ideal components;

(2) a 50% reduction in the number of variable rf devices required for a given dynamic phase range of operation and a given phase step size;

(3) a smaller volume is required, leading to a much more compact network;

(4) a 50% reduction in the complexity of the control signal circuit which is required for operating the network;

(5) a reduction in the number of diodes which have to be made conductive. For example, in a conventional 4-bit phase shifter, eight diodes will have to be turned on, compared with only four diodes in the present invention. This results in a saving in power extracted from the battery or other dc supply, and (6) in a given system requiring a multiplicity of phase-shifters to control a given number of signal paths in a pair-wise asymetric fashion, it will be seen that by using the present invention only half the number of phase-shifters will be required.

I claim:

1. A variable dual phase shifter for simultaneously varying the phase shifts in two signal paths by equal and opposite amounts, said phase shifter comprising a pair of substantially identical transmission lines; a pair of 90° l hybrids each having two output ports, the output ports of one hybrid being connected to the output ports of the other hybrid via the pair of transmission lines; a plurality of radio-frequency variable-impedance devices shunt to the connected transmission lines at positions spaced apart along the lines, the positions on one line corresponding to those on the other line, as measured from the same hybrid; and means for controlling the impedances of the variable-impedance devices to produce a reflective shunt impedance different from the characteristic impedance of the respective line at a selected position on one line and at the corresponding position on the other line.

2. A phase shifter according to claim 1, wherein the variable-impedance devices are arranged in pairs, the devices of each pair being coupled to respective corresponding positions on the transmission lines.

3. A phase shifter according to claim 1, wherein each variable-impedance device is coupled to a respective pair of corresponding positions on the transmission lines via two ¼-wavelength lines.

4. A phase shifter according to claim 1, wherein each variable-impedance device is a p-i-n diode.

5. A phase shifter according to claim 4, wherein the p-i-n diodes are selectively switched between non-conductive and conductive states to determine the position of the reflective shunt impedance.

6. A phase shifter according to claim 4, wherein the p-i-n diodes are selectively switchable between a non-conductive state and a state of at least partial conduction, whereby variable attenuation in the signal paths is obtainable.

7. A phase shifter according to claim 4, further including a plurality of capacitors, each of said capacitors being connected in series with a respective one of said p-i-n diodes for tuning-out the inductive reactance of that diode when the diode is in a conductive state, and said phase shifter further including a plurality of shunt inductances each provided fro tuning-out the capacitive reactance of an associate diode when that diode is in a non-conductive state.

8. A phase shifter network, comprising two phase shifters according to claim 1 connected in cascade, a first one of the phase shifters providing coarse increments of phase shift, and second one of the phase shifters having a plurality of said variable impedance devices located in a central region of the length of the lines, whereby fine increments of phase shift can be obtained by controlling the impedance of variable impedance devices in both of the phase shifters simultaneously.

* * * * *